United States Patent [19]

Hofmeister et al.

[11] 3,955,449

[45] May 11, 1976

[54] ADJUSTMENT TOOL FOR ROTATABLE INSTRUMENTALITIES

[75] Inventors: Richard J. Hofmeister, Arlington Heights; Edward A. Salners, Mount Prospect, both of Ill.

[73] Assignee: Quasar Electronics Corporation, Franklin Park, Ill.

[22] Filed: June 13, 1975

[21] Appl. No.: 586,878

[52] U.S. Cl. ..... 81/3 R; 338/166

[51] Int. Cl.[2] ..... B25B 23/16

[58] Field of Search ..... 81/3 R; 338/166

[56] References Cited

UNITED STATES PATENTS

| | | | |
|---|---|---|---|
| 2,082,979 | 6/1937 | Schellenger | 338/166 X |
| 2,669,634 | 2/1954 | Daily et al. | 338/166 |
| 3,382,473 | 5/1968 | Bemthuysen et al. | 338/166 |

FOREIGN PATENTS OR APPLICATIONS

| | | | |
|---|---|---|---|
| 667,719 | 3/1952 | United Kingdom | 338/166 |
| 736,044 | 8/1955 | United Kingdom | 338/166 |

*Primary Examiner*—Al Lawrence Smith
*Assistant Examiner*—Roscoe V. Parker
*Attorney, Agent, or Firm*—LaValle D. Ptak

[57] ABSTRACT

An adjustment tool for a rotatable preset potentiometer used in television receivers, or the like, is formed of one-piece, molded plastic material and is insertable into the hollow rotatable hub of the potentiometer. The tool has a shaft which extends into and through the hub of the potentiometer. A resilient, deformable locking member which normally expands to a size greater than the hole in the hub, is carried on one end of the shaft. The locking member is compressible upon insertion into and removal from the hub, and is located to expand outside the hub when the tool is inserted into place. Drive slots are formed in the end of the hub. The tool has a pair of drive slot engaging members at its other end which limit the depth to which the tool can be inserted. These members engage the slots in the hub to permit the tool and the hub to be rotated together. An enlarged head is formed on the end of the shaft having the slot engaging members on it and is of a size to permit it to be grasped for manual rotation. The head also includes a screwdriver receiving slot in it, and has cammed surfaces sloping toward the slot to facilitate the location of a screwdriver blade into the slot, so that the adjustment of the potentiometer can be easily effected.

10 Claims, 6 Drawing Figures

ADJUSTMENT TOOL FOR ROTATABLE INSTRUMENTALITIES

BACKGROUND OF THE INVENTION

In television receivers and other electronic instrumentalities, variable resistance control units are often employed to provide preset resistance adjustments in the circuits. These preset variable resistance controls are used extensively in television receivers, and the adjustments are generally made by a skilled technician at the factory, or are made by servicemen after the television receiver leaves the factory. These controls are used infrequently; and, in fact, often are never touched after the initial adjustment at the factory. Because of this, the preset variable resistance controls or potentiometers are generally mounted in relatively inaccessible locations on the receiver chassis.

The preset variable resistance potentiometers used in television receivers are relatively small in size. Generally, they have a hollow rotatable hub with a screwdriver receiving slot in either end to permit adjustment from either side of the potentiometer, and/or with a hexagonal internal configuration to permit the insertion of an hexagonal wrench or tool for adjustment. Because of the small size and the fact that these controls sometimes are located in a position which requires a relatively long-handled tool to reach them, making accurate adjustments by use of a screwdriver or hexagonal "Allen" wrench is difficult and time consuming. In addition, the removal of the wrench or screwdriver can result in misadjustments caused by slight rotational movements effected when the tool is removed.

Attempts have been made to provide plug-in rotatable shafts which are inserted into the hollow rotatable hubs of the potentiometers and which have an enlarged head to facilitate rotation of the combined shaft and hub. One plug-in shaft of this type is disclosed in U.S. Pat. No. 2,669,634 to Daily et al. The shaft of the Daily patent, however, is subject to the disadvantage that when it is located at a point within the receiver where it cannot be conveniently grasped by the fingers of the person making the adjustment, the adjustment must be made in the conventional manner by a screwdriver operating directly upon the slot in the rotatable hub of the potentiometer. The disadvantages mentioned previously thus are still present and are not overcome. The plug-in shaft of Daily et al does not include a provision for utilizing it to facilitate the guiding of a screwdriver or a similar tool into operating position.

As a consequence, it is desirable to provide a removable plug-in shaft for preset variable resistance potentiometers which facilitates accurate adjustment of the potentiometer resistance and which further may be easily rotated directly or by means of a screwdriver or the like.

SUMMARY OF THE INVENTION

Accordingly, it is an object of this invention to provide an improved adjustment tool for rotatable instrumentalities.

It is another object of this invention to provide an improved adjustment tool for variable potentiometers.

It is an additional object of this invention to provide an adjustment tool in the form of a removable plug-in shaft which may be rotated either by hand or through the use of a screwdriver or the like.

It is a further object of this invention to provide an adjustment tool for a rotatable potentiometer which is inexpensive to manufacture.

It is yet another object of this invention to provide an adjustment tool for a rotatable potentiometer which facilitates accurate adjustment of the potentiometer.

In accordance with a preferred embodiment of this invention, an adjustment tool for a potentiometer is molded of plastic material and includes a shaft having a diameter and length dimensioned to permit passage through the hollow hub of the rotatable member of the potentiometer to be adjusted. One end of the shaft has an expandable, resilient locking member on it which normally expands to a size greater than the internal diameter of the hollow hub of the potentiometer adjusting member. Cam surfaces on the locking member permit it to be inserted and removed from the hub, and the locking member is compressible to permit it to pass through the hub. Located on the shaft of the tool near the other end are a pair of drive slot engaging members extending radially outwardly from the shaft. These driving members are engageable with corresponding slots on the end of the hollow potentiometer adjustment hub, and determine the depth to which the shaft can be inserted into the hub, as well as providing a driving engagement between the adjustment tool and the hub. An enlarged head also is provided on the end of the shaft having the drive slot engaging members on it for facilitating the rotation of the tool. The enlarged head is generally of a circular configuration having a slot across its diameter, and it is folded outwardly at a slight angle from the slot to provide a pair of screwdriver blade guide surfaces to guide a screwdriver blade into engagement with the slot.

DETAILED DESCRIPTION

Figure 1:
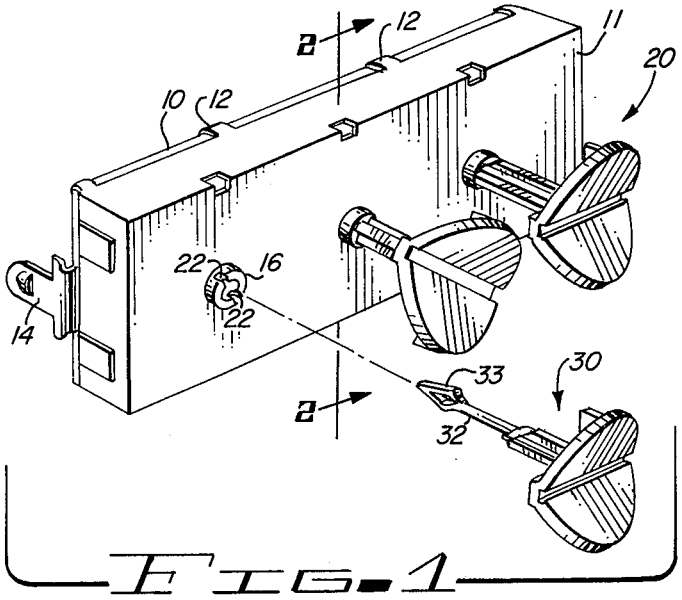
FIG. 1 is a perspective view of a typical potentiometer assembly showing two adjustment tools according to a preferred embodiment of the invention inserted into operating position into the hollow hubs of potentiometer devices, and showing a third tool ready to be inserted into engagement with the hub of a third potentiometer device.
Figure 3:
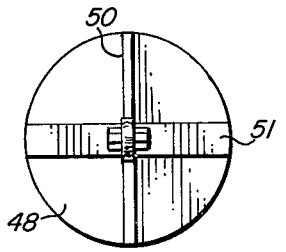
FIGS. 3 and 4 are bottom and top views, respectively, of the tool shown in FIGS. 1 and 2.
Figure 4:
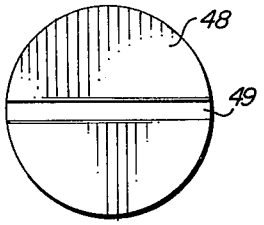

In the figures of the drawing, like reference numbers are used throughout to designate the same or similar components. Referring now to FIG. 1, there is shown a typical potentiometer mounting assembly of the type used in television receivers. The assembly includes three potentiometers mounted on an insulating substrate 10 and capped with a stamped metal cover 11 which is secured to the insulating base 10 by means of bent-over tabs 12 in a conventional manner. To facilitate the mounting of the assembly of FIG. 1 into a television chassis, a pair of downwardly extending mounting feet 14 are integrally formed with the cover 11 to permit snapping the potentiometer unit into place by extending the mounting feet 14 into corresponding slots in the chassis of the receiver. The assembly shown in FIG. 1 includes three potentiometers, each of which has a rotatable adjustment hub 16 extending through it. The hub 16 has one end extending out of the cover 11 and the other end extending through the insulating base member 10 (see most clearly in FIG. 2).

Figure 2:
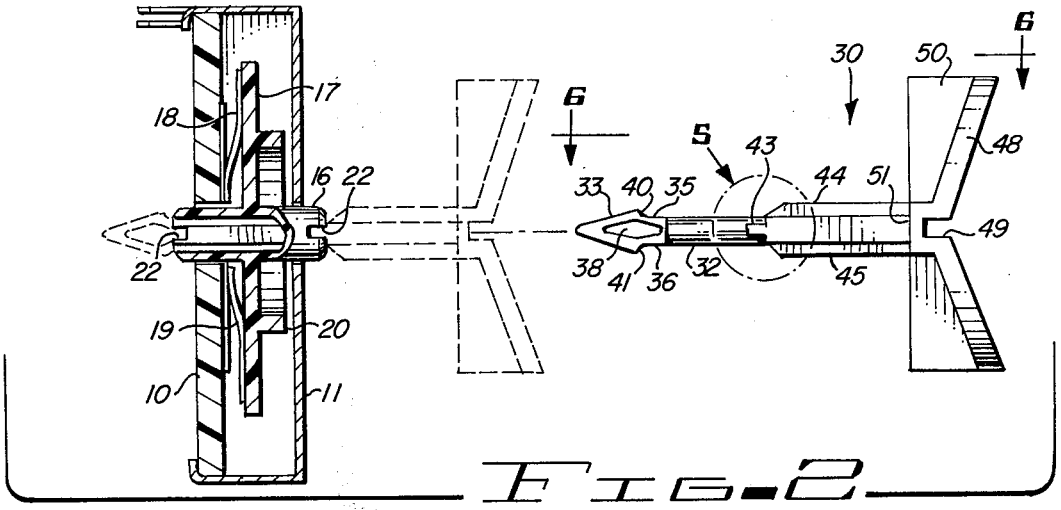
FIG. 2 shows a partially cutaway view of the assembly of FIG. 1, illustrating the components thereof in greater detail.

As shown in FIG. 2, each hub 16 is integrally formed as part of a rotatable adjustment member having an outwardly extending flange 17. Suitable resistance and conductor wipers 18 and 19 are attached to the flange 17 for engagement with resistance rings and conductive rings on the base member 10. The wipers 18 and 19 are made of spring material, so that when the unit is fully assembled as shown in FIGS. 1 and 2, a bearing portion 20 on the flange 17 is forced into engagement with the inside of the metal cover 11 under the urging of the resilient spring wipers 18 and 19.

The hollow hub 16 of the adjustment member of the potentiometer has a pair of diametrically opposite notches 22 formed in each end. These notches 22 are commonly used as a drive slot for engagement by a tool, such as a screwdriver or the like, which then is used to rotate the hub 16, and therefore the wipers 18 and 19, to effect the desired adjustment of the potentiometer.

Because the potentiometer assembly often is located in difficult-to-reach places of the television receiver, it is desirable to provide a readily detachable, plug-in, operating shaft and tool for effecting rotational adjustment of the hubs 16 of the potentiometers. Such a tool 30 is shown in the various figures of the drawing. The tool 30 preferably is formed of nylon or other suitable plastic material, molded as a single unitary element. It includes a first shaft portion 32 which has a diameter less than the internal diameter of the hollow hub 16 and which has a length sufficient to permit a V-shaped, flared locking member 33 of the tool to pass through the hub 16 and extend outside the hub on the opposite side, as shown in dotted lines in FIG. 2. The member 33 is attached to the shaft portion 32 by a pair of resilient webs 35, 36 which, along with the locking member 33, define an opening 38 between the ends of the V of the locking member 33. The junctions of the webs 35 and 36 with the locking member 33 are in the form of a pair of cam surfaces 40 and 41 which permit removal of the tool 30 from a hub 16 if desired.

Figure 5:
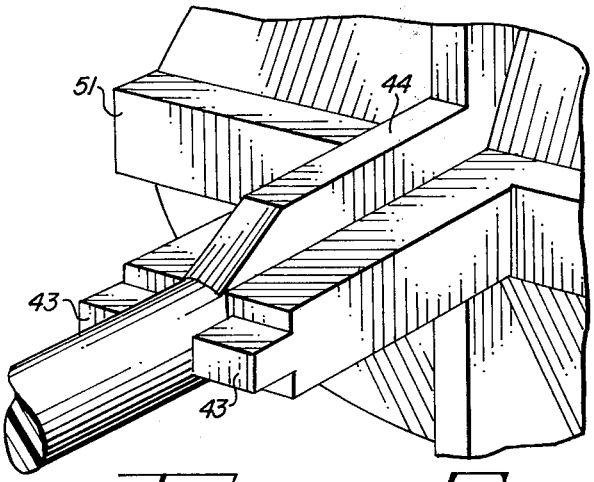
FIG. 5 is a detailed perspective view of a portion of the tool shown in FIG. 2.
Figure 6:
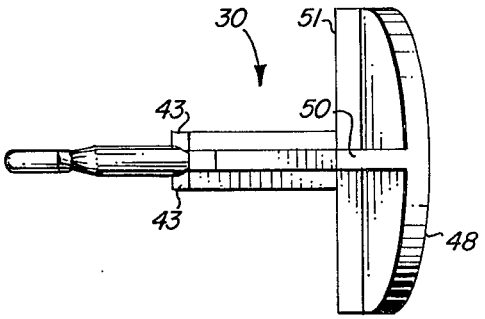
FIG. 6 is a side view of the tool shown in FIG. 2 rotated 90° to show additional details thereof.

When the tool 30 is inserted into a hub 16 from the position shown in solid lines in FIG. 2 to the position shown in dotted lines, the arms of the V-shaped locking member 33 are compressed inwardly into the opening 38 to fit the internal diameter of the hub 16 until the tool 30 is fully inserted to the dotted-line position. After the dotted-line position of FIG. 2 is reached, the locking member 33 once again expands to its normal solid line configuration. This then locks the tool 30 into the hub 16. To limit the distance to which the tool is inserted and also to provide a driving engagement with the hub 16, a pair of drive slot engaging extensions 43, located on diametrically opposite sides of the shaft 32 (see FIGS. 2, 5 and 6), engage the bottoms of the slots 22 in the hub 16 when the tool 30 is fully inserted into the hub 16.

Additional strengthening of the tool 30 and limiting of the insertion depth of the tool is provided by a pair of ribs 44, 45 located diametrically opposite one another and rotated 90° from the slot engaging members 43.

The tool 30 is completed by an enlarged head 48 of a generally circular configuration to permit it to be grasped and rotated by the fingers of the person desiring to make an adjustment of the potentiometer into which the tool 30 is inserted. In some locations within the television receiver chassis, however, it is difficult to grasp the head 48. For this reason, the head 48 has a screwdriver receiving slot 49 across a diameter; and the two halves of the head on opposite sides of the slot 49 slope inwardly toward the slot. This aids in guiding the blade of a screwdriver into engagement with the slot 49, even though the tool 30 may be located at an inconvenient place in the chassis of the equipment in which it is used.

Additional strength for the head 48 is provided in the form of transverse ribs 50 and 51 which are integrally formed with the rest of the tool 30.

The tool 30 preferably is made of a one-piece molded device, and the cam surfaces on the forward and rear edges of the locking member 33 facilitates the insertion and removal of the tool from the hub 16 of the potentiometer as desired. Thus, once an adjustment of a potentiometer 16 has been effected, the tool 30 can be removed. Alternatively, the tool 30 can be left in place for facilitating future additional adjustments, if it should be determined that it is desirable to do so.

I claim:

1. An adjustment tool for a rotatable instrumentality in a housing, such instrumentality having a hollow, rotatable hub of a predetermined length, with an end extending beyond the wall of the housing and having a drive slot in the extremity of such end, said tool including in combination:

a shaft having a first portion thereof with a diameter and length dimensions sufficient to pass through the hollow hub;

a resilient locking member at one end of said shaft, said locking member normally expanded to a size greater than the internal diameter of the hollow hub, and having cam surfaces thereon to permit insertion and removal of said shaft from said hub, said locking member being resiliently compressible to allow passage thereof through the hollow hub;

a drive slot engaging means at the other end of said shaft and extending radially outwardly therefrom for matingly engaging the drive slot in the end of the hub to limit the distance said shaft is insertable into the hub and to provide a driving connection between said shaft and the hub; and an enlarged head on said other end of said shaft for facilitating manual rotation thereof, said enlarged head having a screwdriver receiving slot therein and cam surfaces adjacent the screwdriver receiving slot for guiding screwdriver blades into engagement with the receiving slot.

2. The combination according to claim 1 wherein said adjustment tool is made of a single piece of molded plastic material.

3. The combination according to claim 1 wherein the length of said first portion of said shaft between said locking member and said drive slot engaging means is substantially the same as the length of said hollow hub between the bottom of the drive slot therein and the opposite end thereof.

4. The combination according to claim 1 wherein said resilient locking member comprises a hollow, enlarged member attached to said one end of said shaft and made of material which is compressible into the hollow portion thereof when said shaft is inserted into and removed from the hollow hub.

5. The combination according to claim 1 wherein said enlarged head is a circular head, with the screwdriver receiving slot extending across a diameter thereof, and further being folded outwardly from the end of the shaft to which said head is attached to form two surfaces sloping toward the screwdriver receiving slot on opposite sides thereof.

6. The combination according to claim 5 further including support ribs on the underside of said enlarged head for increasing the rigidity thereof.

7. The combination according to claim 5 wherein the drive slot in the end of the hub extends across the diameter of the hub, and wherein said drive slot engaging means comprises blade portions extending radially outwardly from said shaft on opposite sides thereof for matingly engaging the drive slot in the end of the hub on both sides thereof.

8. The combination according to claim 7 wherein said adjustment tool is formed of a single piece of molded plastic material.

9. The combination according to claim 8 wherein said resilient locking member comprises a substantially V-shaped member on said one end of said shaft, said member having an opening therethrough to permit the collapsing of said V when said member is inserted into and removed from the hub.

10. The combination according to claim 9 wherein said resilient locking member is attached to said one end of said shaft by web portions extending from said one end to the open ends of said V to form cam surfaces on opposite sides thereof for engagement with the end of the hollow hub to collapse said V-shaped locking member upon withdrawal of said adjustment tool from the hollow hub.

* * * * *